US006688796B1

(12) United States Patent
Liu

(10) Patent No.: US 6,688,796 B1
(45) Date of Patent: Feb. 10, 2004

(54) BRUSH FOR MAKE-UP

(76) Inventor: Ming Hsiung Liu, PO Box 82-144, Taipei (TW)

( * ) Notice: Subject to any disclaimer, the term of this patent is extended or adjusted under 35 U.S.C. 154(b) by 0 days.

(21) Appl. No.: 10/411,262

(22) Filed: Apr. 11, 2003

(51) Int. Cl.[7] ..... A46B 11/04; A47L 13/22

(52) U.S. Cl. ..... 401/277; 401/279; 401/286; 401/172; 401/174

(58) Field of Search ..... 401/171–174, 401/270, 277, 279, 286

(56) References Cited

U.S. PATENT DOCUMENTS 5,803,640 A * 9/1998 Nakajima et al. ..... 401/174
5,827,002 A * 10/1998 Nakajima ..... 401/174
5,851,079 A * 12/1998 Horstman et al. ..... 401/174
6,176,632 B1 * 1/2001 Kageyama et al. ..... 401/279
6,227,739 B1 * 5/2001 Kageyama ..... 401/172
6,474,891 B1 * 11/2002 Liu ..... 401/174

* cited by examiner

*Primary Examiner*—Tuan N. Nguyen
(74) *Attorney, Agent, or Firm*—Leong C. Lei

(57) ABSTRACT

A press-type make-up brush is disclosed and the brush comprises a brush shaft having a cavity to contain cosmetic fluid; a brush tip positioned at one end of the shaft and containing a brushing section protruded beyond the end portion thereof; a cap body covered the outside of the brush tip; a squeezing device mounted at one end of the shaft; including a screw shaft having one end being a piston extended to the cavity, a driving device having one end provided with a screw hole for mounting the other end of the screw shaft, and one end of the driving device being a press button with restoration force, and each pressing of the press button caused the screw shaft to turn with an angle, thereby the screw shaft moves to a position by means of the screw hole and the make-up fluid within the cavity is squeezed out for utilization.

6 Claims, 5 Drawing Sheets

BRUSH FOR MAKE-UP

BACKGROUND OF THE INVENTION (a) Technical Field of the Invention

The present invention relates to a brush for use in make-up, and in particular, a press-type make-up brush which can control the quantity of dispensing cosmetic therefrom.

(b) Description of the Prior Art

Conventional brush for make-up possesses the following drawbacks:

(a) Inconvenience: Generally, cosmetic cream and brush are separated from one another and it may not be convenient to obtain the required cream for make-up.

(b) Uncontrolled quantity: The quantity of cosmetic for make-up cannot be controlled easily. As a result, when the cosmetic is applied to facial area, the make-up is normally uneven.

Accordingly, it is an object of the present invention to provide a press-type make-up brush which mitigates the above-mentioned drawbacks.

SUMMARY OF THE INVENTION

Accordingly, it is an object of the present invention to provide a brush shaft having a cavity to contain cosmetic fluid; a brush tip positioned at one end of the shaft and containing a brushing section protruded beyond the end portion thereof; a cap body covered the outside of the brush tip; a squeezing device mounted at one end of the shaft; including a screw shaft having one end being a piston extended to the cavity, a driving device having one end provided with a screw hole for mounting the other end of the screw shaft, and one end of the driving device being a press button with restoration force, and each pressing of the press button caused the screw shaft to turn with an angle, thereby the screw shaft moves to a position by means of the screw hole and the make-up fluid within the cavity is squeezed out for utilization.

Still a further object of the present invention is to provide a press-type make-up brush, the top end of the brush body is a protruded edge having a plurality of protruded rings, and an opening at the inner side wall of the cap body is a stepped slot for engaging with the protruded edge so as to cover the brush tip therein, and the wall of the hole of the stepped slot is provided with a plurality of protruded blocks for engagement at the lower section of the protruded ring Another object of the present invention is to provide a press-type make-up brush, wherein the wall of the hole of the protruded edge is provided with a plurality of engaging slots, the engaging edge of the mounting head having a plurality of ribs for engagement with the engaging slots.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
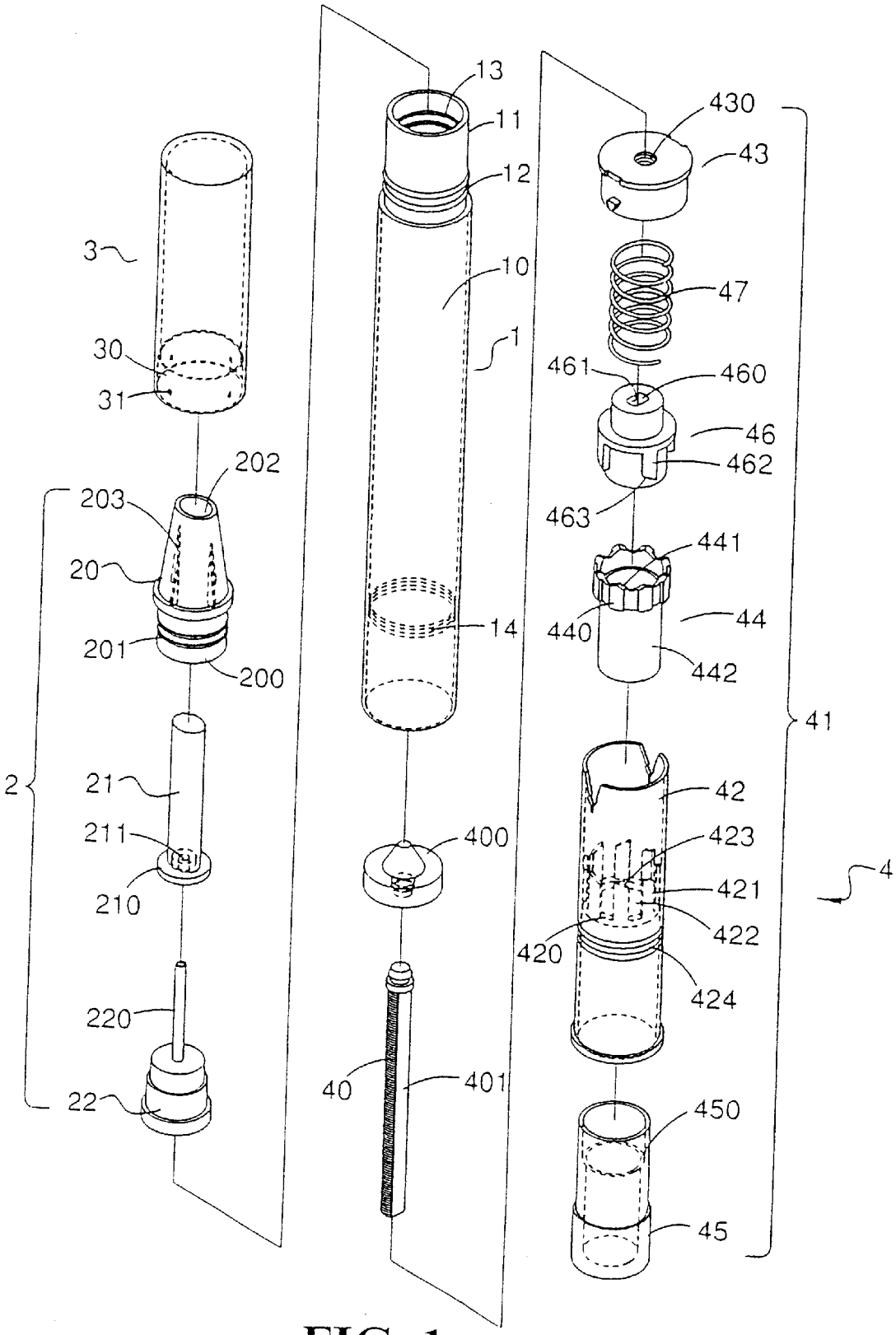
FIG. 1 is an exploded perspective view of the present invention.
Figure 2:
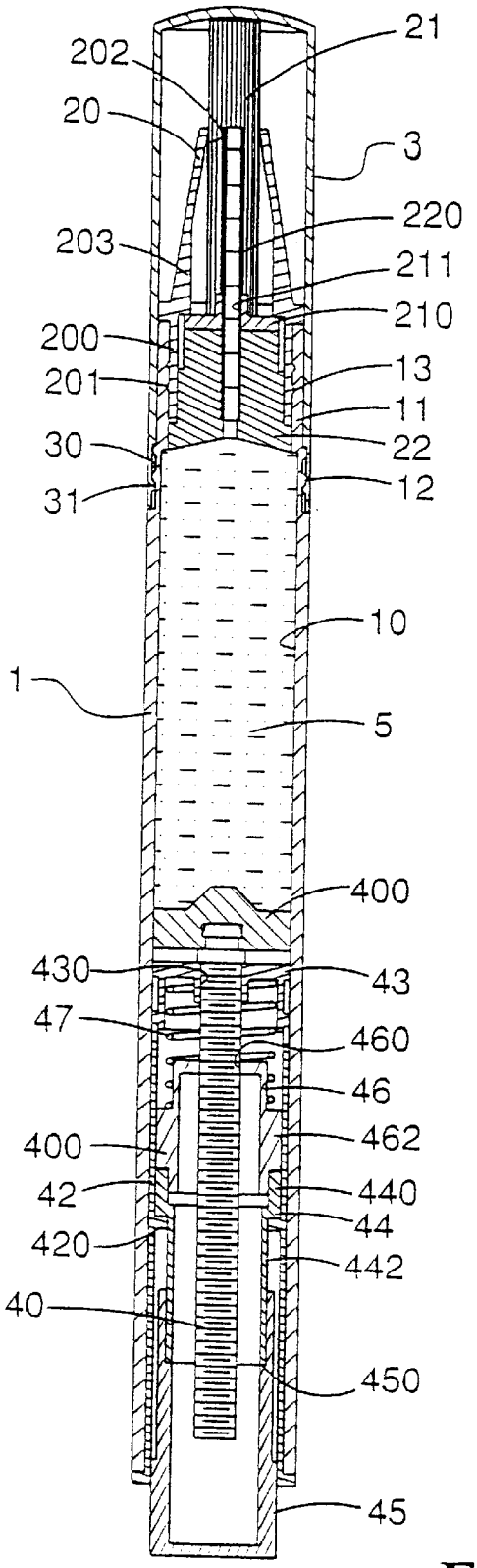
FIG. 2 is a sectional view of the press-type make-up brush in accordance with the present invention.

Referring to FIGS. 1 to 2, there is shown a press-type make-up brush comprising a brush shaft 1, a brush tip 2, a cap body 3 and a squeezing device 4, wherein a brush shaft 1 having a cavity 10 to contain cosmetic fluid 5; a brush tip 2 positioned at one end of the shaft 1 and containing a brushing section protruded beyond the end portion thereof; a cap body 3 covered the outside of the brush tip 2; a squeezing device 4 mounted at one end of the shaft 1; including a screw shaft 40 having one end being a piston 400 extended to the cavity 10, a driving device 41 having one end provided with a screw hole for mounting the other end of the screw shaft 40, and one end of the driving device 41 being a press button 45 with restoration force, and each pressing of the press button 45 caused the screw shaft 40 to turn with an angle, thereby the screw shaft 40 moves to a position by means of the screw hole and the make-up fluid 5 within the cavity 10 is squeezed out for utilization; the top end of the shaft 1 is a protruded edge having a plurality of protruded rings 14, and an opening at the inner side wall of the cap body 20 is a stepped slot 30 for engaging with the protruded edge 11 so as to cover the brush tip 2 therein, and the wall of the hole of the stepped slot 30 is provided with a plurality of protruded blocks 31 for engagement at the lower section of the protruded ring 12. The brush tip 2 includes a mounting head 2 having one end provided with an engaging edge for mounting with an opening at the top end of the brush shaft 1, the mounting head 2 being provided with a through hole 202 having a hole wall provided with a plurality of ribs 203; a make-up brush insertably mounted at the through hole 202 and one end of the make-up brush being exposed at the external of the mounting head 2, and the other end being a protruded seat urging the bottom section of the rib 203 and a through hole being provided at the protruded seat; and a dispensing needle head 22 mounted at the bottom section of the mounting head 20 and the top thereof being a dispensing needle tube 220 passed through the through hole 211 of the protruded seat. The wall of the hole of the protruded edge is provided with a plurality of engaging slots, the engaging edge of the mounting head having a plurality of ribs for engagement with the engaging slots. The driving device 41 includes a shell body 42, the inner wall being a ring protruded edge 420 and one side of the inner wall being a railing rib 421 with a plurality of axial directions, each railing rib 421 being a sliding slot 422, and one end of the railing rib 421 being a guiding sloping face 423; a pivot block 43 mounted at one end of the shell body 42 and the pivot block 43 provided with screw hole for mounting with the screw shaft 40; an axial pushing block 44 having a plurality of protruded rails 440 at the circumferential edge thereof for sliding engagement at the sliding slot 460, and the end section of the protruded rail being a slanting face 441, and one side of the axial pushing block 44 protruded with a pushing section; a press button having one end protruded beyond the exterior of the shell body 42 and the other end thereof being an urging edge to urge the pushing section of the axial pushing block 44; a rotating sliding block 46 provided with a sliding hole 460 for mounting at one end of the screw shaft 40 and the circumferential edge 424 of the rotating sliding block 46 provided with a plurality of sliding ribs 462, and the end sections of the sliding ribs 462 being a slanting face 441 relatively urging the slanting face 441 of the protruded rail 440 of the axial pushing block 44; and a compression spring 47 having one end pressed one side of the pivotal block 43, and the other end pressed one side of the rotating sliding block 46.

Figure 3:
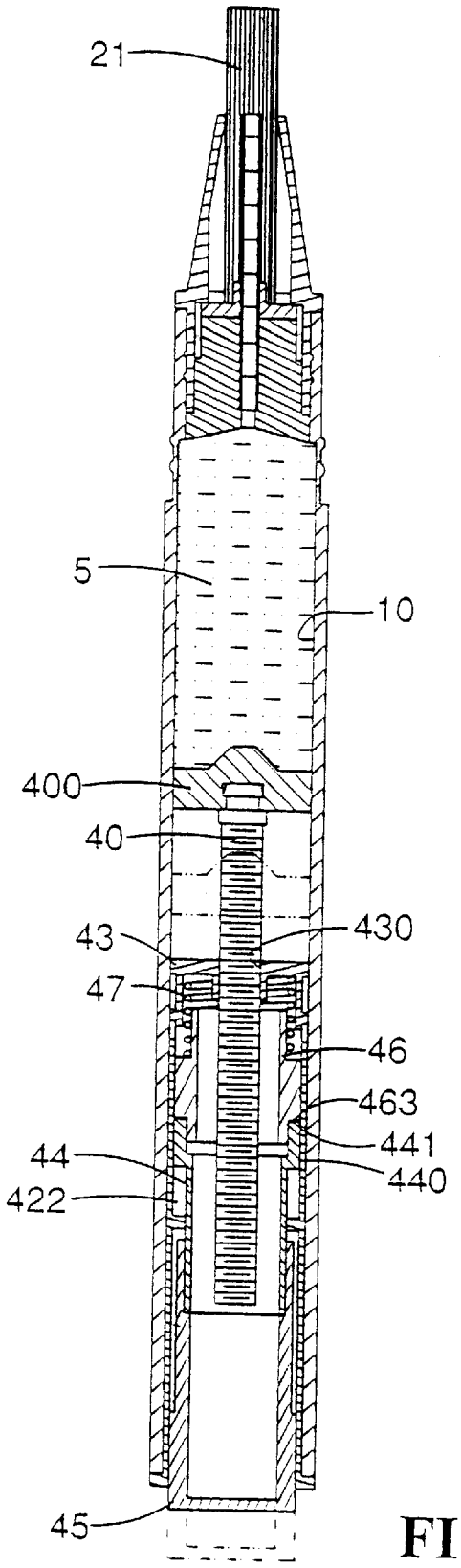
FIG. 3 is a schematic view showing the pressing of the brush in accordance with the present invention.
Figure 4:
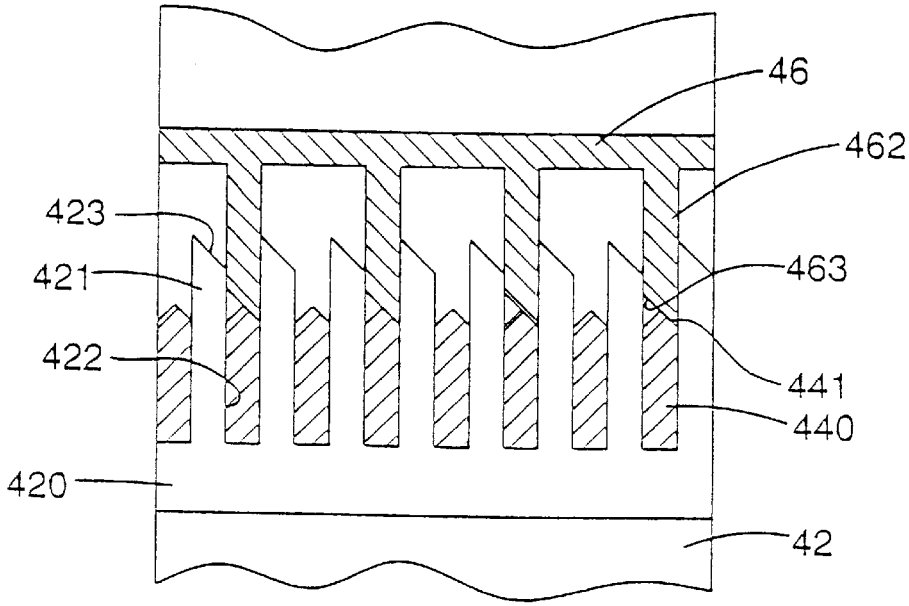
FIGS. 4 to 7 are schematic views showing the relative action of the driving device in accordance with the present invention.
Figure 5:
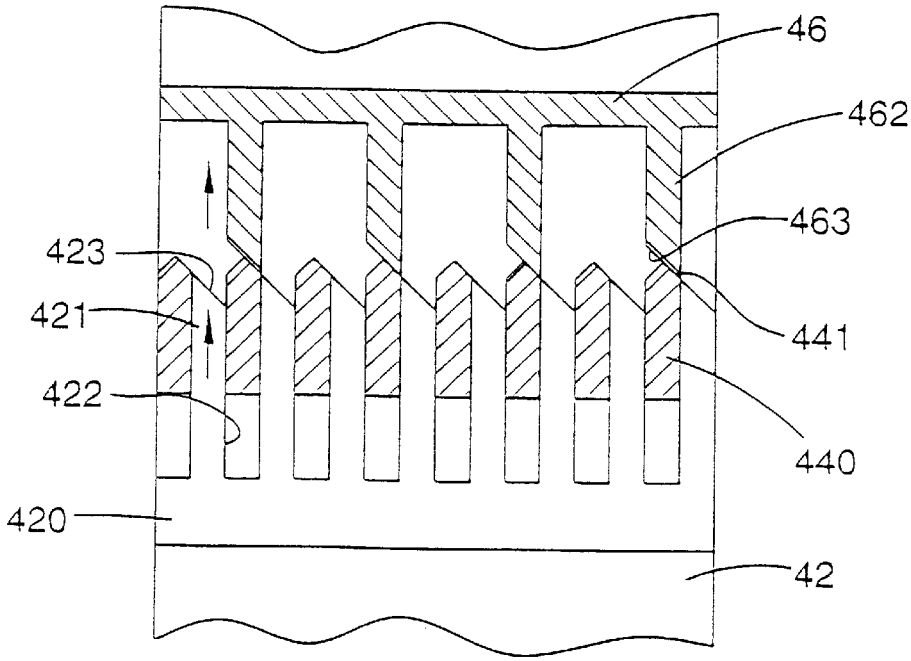
Figure 6:
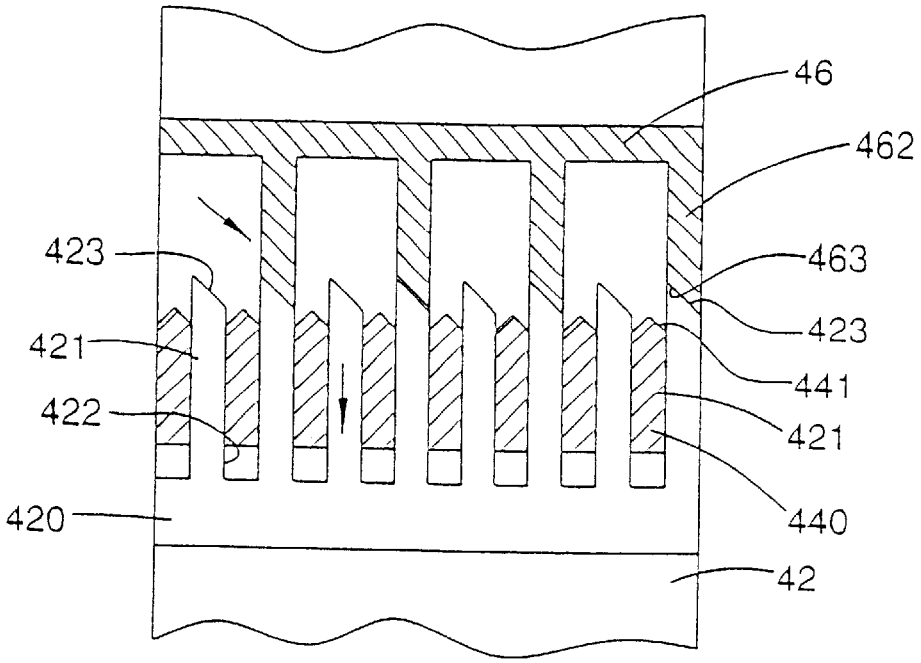
Figure 7:
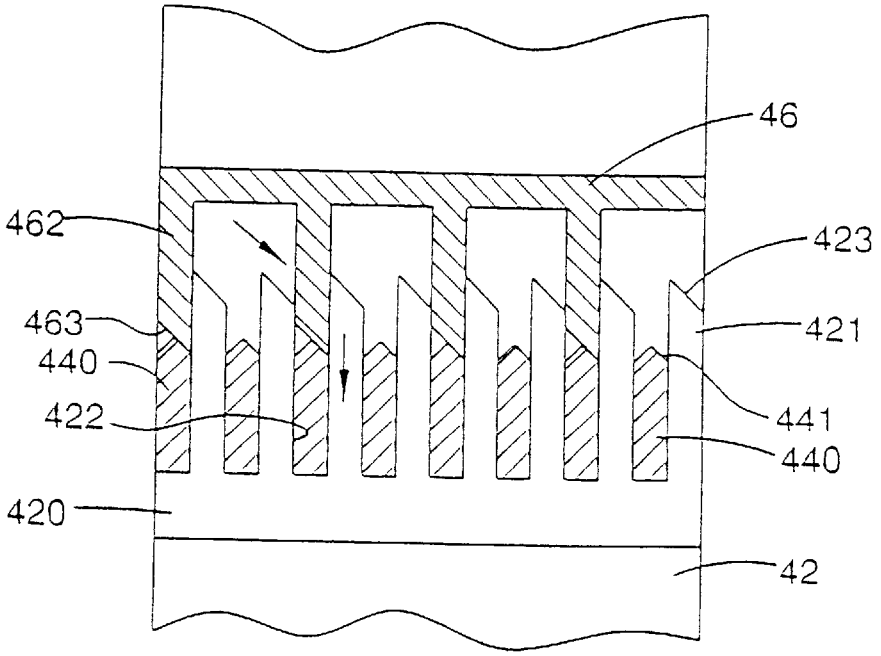

Referring to FIGS. 3 to 5, when the pres button 45 is pressed, the axial pushing block 44 will be pushed upward. At the same time, the rotating sliding block 46 will move due to the urging of the axial pushing block 44. When the sliding sloping face 463 of the rotating sliding block 46 is pushed to the end section of the sliding slot 422 by the sliding slot 422, the rotating sliding block 46 will urge by the compression spring 47 and the sliding sloping face 463 will move to the guiding sloping face 423 of the railing rib 421 along the sloping face 441 of the protruded rail 440, and at the time of moving to the guiding sloping face 423, the end face of the axial pushing block 44 will urge by the sliding sloping face 463 and be lowered to the sliding slot 422, as shown in FIG. 6. When the sliding sloping face 463 slides further along the guiding sloping face 463 to the top of the sliding slot 422, the protruded rail 440 will press against the sliding slot 422, as shown in FIG. 7. Thus the rotating angle of the rotating sliding block 46 is changed. When the press button 45 is pressed continuously, the rotating sliding block 46 will rotate in one direction.

Referring to FIGS. 1 to 3, when the rotating sliding block 46 rotates, the screw shaft 40 will rotate as a result of the limiting flat face 461 with respect to the positioning flat face 401. At the same time, the rotating of the screw shaft 40 causes an axial displacement due to the action of the screw hole 430 of the pivotal block 43 so that one end of the piston 400 will squeeze the make-up fluid 5 from the cavity 10 into the make-up brush 21, achieving effectively control of the quantity of the cosmetic for make-up application.

The advantages of the present invention are as follows:

(1) Portability: As the make-up fluid 5 and the make-up brush are formed as a unit and the shape being a pen-like, the brush can be easily and conveniently kept.

(2) Quantity of make-up fluid. The press button 45 controls the upward motion of the piston 400 and therefore the dispensing make-up fluid is fixed.

I claim:

1. A press-type make-up brush comprising:

(a) a brush shaft having a cavity to contain cosmetic fluid;

(b) a brush tip positioned at one end of the shaft and containing a brushing section protruded beyond the end portion thereof;

(c) a cap body covered the outside of the brush tip;

(d) a squeezing device mounted at the other end of the shaft, including a screw shaft having one end being a piston extended to the cavity, a driving device having one end provided with a screw hole for mounting the other end of the screw shaft, and the other end of the driving device being a press button with restoration force, and each pressing of the press button caused the screw shaft to turn with an angle, thereby the screw shaft moves to a position by means of the screw hole and the make-up fluid within the cavity is squeezed out for utilization.

2. The brush of claim 1, wherein the top end of the brush body is a protruded edge having a plurality of protruded rings, and an opening at the inner side wall of the cap body is a stepped slot for engaging with the protruded edge so as to cover the brush tip therein, and the wall of the hole of the stepped slot is provided with a plurality of protruded blocks for engagement at the lower section of the protruded ring.

3. The brush of claim 1, wherein the brush tip includes:

(a) a mounting head having one end provided with an engaging edge for mounting with an opening at the top end of the brush shaft, the mounting head being provided with a through hole having a hole wall provided with a plurality of ribs;

(b) a make-up brush insertably mounted at the through hole and one end of the make-up brush being exposed at the external of the mounting head, and the other end being a protruded seat urging the bottom section of the rib and a through hole being provided at the protruded seat; and (c) a dispensing needle head mounted at the bottom section of the mounting head and the top thereof being a dispensing needle tube passed through the through hole of the protruded seat.

4. The brush of claim 2, wherein the wall of the hole of the protruded edge is provided with a plurality of engaging slots, the engaging edge of the mounting head having a plurality of ribs for engagement with the engaging slots.

5. The brush of claim 1, wherein the driving device includes:

(a) a shell body, the inner wall being a ring protruded edge and one side of the inner wall being a railing rib with a plurality of axial directions, each railing rib being a sliding slot, and one end of the railing rib being a guiding sloping face;

(b) a pivot block mounted at one end of the shell body and the pivot block provided with screw hole for mounting with the screw shaft;

(c) an axial pushing block having a plurality of protruded rails at the circumferential edge thereof for sliding engagement at the sliding slot, and the end section of the protruded rail being a slanting face, and one side of the axial pushing block protruded with a pushing section;

(d) a press button having one end protruded beyond the exterior of the shell body and the other end thereof being an urging edge to urge the pushing section of the axial pushing block;

(e) a rotating sliding block provided with a sliding hole for mounting on the screw shaft and the circumferential edge of the rotating sliding block provided with a plurality of sliding ribs, and the end sections of the sliding ribs being a slanting face relatively urging the slanting face of the protruded rail of the axial pushing block; and (f) a compression spring having one end pressed one side of the pivotal block, and the other end pressed one side of the rotating sliding block.

6. The brush of claim 5, wherein the sliding hole of the rotating sliding block is provided with limiting flat surface and the screw shaft corresponding to the limiting flat surface is a positioning flat surface.

* * * * *